US005706980A

United States Patent [19]

Dickerson

[11] Patent Number: 5,706,980

[45] Date of Patent: Jan. 13, 1998

[54] COMESTIBLES CONSUMPTION DEVICE

[76] Inventor: Albert Myron Dickerson, 7893 Windsor Ave., Canal Winchester, Ohio 43310-8902

[21] Appl. No.: 625,140

[22] Filed: Apr. 1, 1996

[51] Int. Cl.[6] ..... B67D 5/56

[52] U.S. Cl. ..... 222/129; 220/501; 222/145.3; 222/454; 222/481.5

[58] Field of Search ..... 222/129, 145.3, 222/454, 481.5; 220/501, 527, 528, 421

[56] References Cited

U.S. PATENT DOCUMENTS

| | | | |
|---|---|---|---|
| 378,752 | 2/1888 | Ader . | |
| 766,587 | 8/1904 | Bradshaw . | |
| 876,808 | 1/1908 | Kinert . | |
| 1,100,298 | 6/1914 | Haas . | |
| 3,298,185 | 1/1967 | Loudon | 220/421 X |
| 3,378,168 | 4/1968 | Hilderbrandt | 222/83 |
| 3,442,435 | 5/1969 | Ludder et al. | 220/528 |
| 3,851,800 | 12/1974 | Swain | 222/481.5 X |
| 4,069,940 | 1/1978 | Naimoli | 220/20 |
| 4,116,354 | 9/1978 | Kenkare et al. | 220/20 |
| 4,288,006 | 9/1981 | Clover, Jr. | 222/42 |
| 4,351,444 | 9/1982 | Majewski | 220/20 |
| 4,482,047 | 11/1984 | Ackermann et al. | 206/219 |
| 4,558,804 | 12/1985 | Keck | 222/130 |
| 4,583,661 | 4/1986 | Clover, Jr. | 222/42 |
| 4,793,323 | 12/1988 | Guida et al. | 126/263 |
| 4,986,433 | 1/1991 | Davis | 220/23.8 |
| 4,993,595 | 2/1991 | Bertram et al. | 222/129 |
| 5,167,973 | 12/1992 | Snyder | 426/115 |
| 5,209,348 | 5/1993 | Schafer | 206/222 |
| 5,209,909 | 5/1993 | Siegel et al. | 422/292 |
| 5,215,214 | 6/1993 | Lev et al. | 222/1 |
| 5,241,835 | 9/1993 | Ascone | 62/372 |
| 5,328,051 | 7/1994 | Potter et al. | 220/575 |
| 5,366,103 | 11/1994 | Abernathy et al. | 220/23.83 |
| 5,588,561 | 12/1996 | Ness | 222/129 |

*Primary Examiner*—Joseph Kaufman

[57] ABSTRACT

A comestibles consumption device (12) for the simultaneous dispensing of a liquid (40), such as milk, and a dry comestible (42), such as cereal, by the force of gravity when tilted for use, directly into the mouth of a consumer without the use of other tools or utensils. The device (12) consists of an outer container (20) for holding the liquid (40); an inner container (22) for holding the dry comestible (42) separate from the liquid (40); preferably a lid (24) with a comestible opening (34) and a cover piece (26) for controlling the flow of the dry comestible (42); and a liquid channel (28) and a liquid opening (32) for controlling the flow of the liquid (40) from the outer container (20). The inner container (22) seals with the outer container (20) to form the liquid channel (28) and a vent channel (46). The liquid (40) flows past the inner container (22), through the liquid channel (28), and out of the liquid opening (32) located just below the comestible opening (34) when the device (12) is tilted for use. The lid (24) preferably attaches to inner container (22) and outer container (20). The dry comestible (42) and liquid (40) can be dispensed simultaneously, separately, or mixed together.

20 Claims, 5 Drawing Sheets

COMESTIBLES CONSUMPTION DEVICE

BACKGROUND 1.0 Field of Invention

This invention relates generally to devices used to dispense and consume multiple comestible products simultaneously where one of the products is a dry solid such as cereal, nuts, or snack foods and the other product is a liquid beverage such as milk, soft drinks, fruit juice, or coffee.

2.0 Background-Prior Art

Due to time constraints traveling to work in the morning, it has become necessary to eat breakfast in the ear traveling to work. If one desires to eat cereal, which is the breakfast of choice for many, it is difficult to do this with bowl and spoon driving a car at 65 MPH. If one puts cereal and milk into any of the commercially available travel containers, one has soon consumed all of the milk and finds a large clump of soggy cereal stuck to the bottom of the container. Consumption of this clump of cereal once again requires a spoon or, if one is daring enough to attempt to get the soggy cereal out of the bottom of the container by tipping it, a cloth to wipe the mess off of one's face and clothes. An additional matter is that if a bowl and spoon could be used, the time to consume the cereal would be greatly increased since one is driving a car or engaged in another activity while consuming the cereal. The cereal would become very soggy because of this additional time lag between placing the cereal and milk in the bowl and the final consumption.

Prior art relating to cereal dispensing devices and multi-component dispensing containers was investigated. A number of patents were found relating to uniquely designed and functioning cereal bowls which separated milk and cereal until final consumption in order to keep the cereal from getting soggy. These included U.S. Pat. No. 876,808 (Kinerr 1/08); U.S. Pat. No. 1,100,298 (Haas 6/14); U.S. Pat. No. 4,069,940 (Naimoli 1/78); U.S. Pat. No. 4,351,444 (Majewski 9/82); U.S. Pat. No. 4,986,433 (Davis 1/91); U.S. Pat. No. 5,209,348 (Schafer 5/93), and U.S. Pat. No. 5,328,051 (Potter et al. 7/94). In addition, U.S. Pat. No. 5,167,973 (Snyder 12/92) and U.S. Pat. No. 5,241,835 (Ascone 9/93) were found to relate to portable devices allowing cereal and milk to be stored and transported separately until final consumption. A common limitation of all of the bowls or devices stated in these patents is that the final consumption is with the use of a spoon. None of these patents describe a device that dispenses the cereal and milk directly from the bowl or device into the mouth of the consumer without the use of a spoon. U.S. Pat. No. 5,366,103 (Abernathy et at. 11/94) relates to a spill-resistant bowl for children which does not separate milk and cereal prior to consumption but could be portable since it contains a lid and is spill resistant in design. Although not specifically stated, a spoon would be required for final consumption.

U.S. Pat. No. 4,558,804 (Keck 12/85) describes a much more unique food consumption appliance for cereals and milk. The cereal is dispensed by means of a multi-chambered, rotary carousel having radially-projecting spoon sections. Liquid is extracted with a straw. The straw is not integral to the device. Although the device is claimed to be portable, it is designed to set on "a preferably level surface" when being used. Dispensing of cereal and liquid is done in an alternating manner with no way of simultaneous dispensing of both milk and cereal. The device is highly complex to manufacture, requiring an undetermined number of parts.

U.S. Pat. No. 4,993,595 (Bertram et at. 2/91) describes a container for multi-component products that includes two separate component compartments covered by a common pouring cap, individual pouting openings for the first and second components, respectively, offset from one another relative to the longitudinal axis of the container and openings in the plane of an outer surface are provided in the cap. Flow control for both components is obtained with a single dial cap piece for adjusting the opening sizes of each container. The relative flow ratio between the two components can not be adjusted since both openings are controlled by the rotation of the same dial. A new dial piece with different size opening would be required to change the ratio of the products being dispensed. The contents of both containers appear to be liquid in nature. No direct consumption of a comestible product is mentioned or implied.

U.S. Pat. No. 4,482,047 (Ackermann et al. 11/84) describes a container for separately receiving two different comestible products such as yogurt and whipped cream. A container within a container is described in which whipped cream is stored in the bottom of the outside container and yogurt is stored in the inner container. To use, the common cover of the two containers is permanently removed and a spoon is used to push the inner container, which is held to the outer container by means of flexible tabs, to the bottom of the outer container. This pushing action forces the contents at the bottom of the outer container between the walls of the two containers and into the top of the inner container. The mixture of yogurt and whipped cream is now eaten with a spoon. This is a one use container and does not dispense the product without the use of an additional appliance, the spoon. Relative movement between the inner and outer container is required.

U.S. Pat. No. 766,587 (Bradshaw 8/04) describes an outer container of liquid, specifically paint, with an inner container of pigment such as bronze-powder. The inner container seals to the outer container and a tight lid seals the inner container. At the time of use the lid and inner container are removed and the contents of the inner container are poured into the paint. The two contents are then mixed by external means. No method is provided for incremental mixing and dispensing of the two components. All of the contents are mixed at one time with partial destruction of the container. Once the contents are mixed, the two chambered container is not reusable in its original form.

None of the prior art describes a hand-held device that simultaneously dispenses a dry comestible and a liquid for immediate consumption without the use of additional tools, such as a spoon or straw, and that allows the ratio of the two materials being dispensed to be easily adjusted while the device is being used.

3.0 Summary of Invention

In view of the prior art as described in the foregoing, the objects of the device described in this patent are to provide:

1) A comestibles consumption device for use by a consumer to store, dispense, and consume various dry comestible products simultaneously with various liquids. The dry comestibles can include such products as cereals, nuts, raisins, popcorn, small snack foods, and small fruits. The liquids can include such products as milk, soft drinks, coffee, ice tea, beer, or fruit juice.
2) A comestibles consumption device that can be held and used simultaneously, with only one hand while performing other activities such as standing, walking, riding a bike, or driving a car. No additional tools are required to dispense and consume the dry comestibles and the liquid from the container.
3) A comestibles consumption device of simple construction that is easy to clean, is low cost to manufacture, and is generally reusable.

4) A comestibles consumption device that the relative ratio of liquid to dry comestible can be varied at the time of dispensing. The dry comestible or the liquid can be dispensed individually if desired.

5) A comestibles consumption device in which the liquid and the dry comestible can be mixed in a controlled manner prior to dispensing.

Still further objects and advantages will become apparent from a consideration of the ensuing description and drawings.

The major problem that exists in attempting to consume cereal and milk by drinking the mixture is that the physical properties and flow characteristics of the two products are so different. Them is even a greater difference when another dry comestible is used in place of cereal. Secondary problems are the variation in flow characteristics, particle size, and solubility of the various cereals. In addition, the properties of the cereal changes as it absorbs milk and the cereal does not flow very well when it is wetted out with milk and becomes soggy. The comestibles consumption device described in this patent is able to solve these problems and meet the objectives of this patent.

The preferred embodiment of the device is comprised of an inner container containing a dry comestible mounted above and fitting into an outer container containing a liquid beverage. A liquid tight, compression seal is developed between the inner and the outer containers. A lid covers the inner container and attaches to one or both of the containers by means of a snap or compression fit creating a comestible storage chamber. Dispensing of the dry comestible from the inner container is through a comestible opening in the lid and is controlled with an adjustable cover piece. A liquid chamber is created between the side walls and the bottom of the outer container and the bottom of the inner container. A liquid channel is created by a predetermined gap between the two containers. The liquid channel allows liquid from within the liquid chamber to exit in-line with and just below the comestible opening when the device is tilted for use by a consumer. The liquid channel prevents the liquid from coming into contact with the dry comestible until both exit the device. The cross sectional area of the liquid channel is made small compared to the cross sectional area of the comestible opening in order to dispense a proportional amount of liquid to comestible.

In the preferred embodiment of the device the outer container consists of a horizontal bottom, sloped or curved vertical side walls with a sealing surface, and an open top. The outer container is cylindrical in shape at the bottom for ease of holding with the hand. Towards the top of the outer container its shape transitions to match the shape of the inner container. The portion of the outer container that matches the inner container depends on how far the inner container fits into the outer container. In the preferred embodiment, the top edge of the inner container fits flush or just above the top edge of the outer container.

The preferred embodiment of the inner container consists of a flat bottom, sloped or curved vertical sides with a sealing surface, an open top, and a very rounded shape such that the inner container will form a seal along the entire top of the outer container except for the liquid channel and a vent channel. The shape of the inner container is wide and shallow to minimize the tilting of the device required to cause the dry comestible to flow out of the inner container. The inner container is also tilted on a slight angle so that the front of the inner container at the liquid and comestible opening is lower than at the back of the inner container. This also helps to minimize the tilting required to cause the comestible to flow. The inner container is sized to hold a normal serving of the dry comestible which would be in the 200 to 500 ml range by volume. The outer container holds a similar volume of the liquid plus the inner container.

In the preferred embodiment of the device, control of the flow of the dry comestible out of the inner container is achieved by the lid to which is attached the adjustable cover piece that can be moved over the comestible opening to partially cover it. The lid matches the outside perimeter of the top of the outer container in shape. It is flat and thin in thickness in the center with a inverted U-shaped channel on the perimeter. The lid allows the inner container to be filled with dry comestible. The inside lip of the outside leg of the inverted U-channel contains a raised bead and seals to the top outside lip of the outer container by means of a snap fit over a corresponding raised bead. The outside lip of the inside leg of the inverted U-channel seals to the top inside lip of the inner container by means of compression or corresponding raised beads. The lid contains the comestible opening on its perimeter. When the lid is installed, the comestible opening is installed in-line and above the liquid opening and is covered by the cover piece. The preferred embodiment of the cover piece is a round disk with various size openings in the disk and is attached to the lid such that by rotating the disk to the appropriate position the comestible opening can be completely shut, can be completely opened, or can be partially opened. The comestible opening ranges between 10 to 30 percent of the lid surface area but can be larger or smaller. The shape of the comestible opening is arched to its maximum opening in the center and tapering down to its smallest opening on the edge. The opening is designed to match the general shape of human lips such that the maximum flow of dry comestible is in the center or the comestible opening and just above the liquid opening. The inner and outer containers form the bottom of the comestible opening when it is located on the perimeter of the lid. The containers may be shaped in this area to aid in consumption and to provide a locator for assembly of the device.

The preferred embodiment of the liquid channel is formed by a continuous and predetermined gap between the inner and the outer container walls located in-line with the comestibles opening. The vent channel is formed in a similar manner but is located 180 degrees opposite the liquid channel. The vent channel facilitates the liquid flow out of the liquid chamber. If a vent is not used, the liquid flow will be greatly reduced and be erratic in nature. Both channels are easy to clean since they are between the inner and outer container walls and are opened up when the containers are separated.

Consumption is accomplished by holding the device with the comestible opening to the mouth of the consumer and tipping the bottom of the device up. The liquid flows from the liquid chamber in the outer container by means of the liquid channel and the liquid opening to just below the comestible opening. The dry comestible flows out of the comestible opening. This allows the simultaneous consumption of both the liquid and the dry comestible with the same motion as taking a drink from a cup. The flow of both products is by gravity. The liquid and the dry comestible meet and mix in the mouth of the user. Control of the comestible flow is by restriction to the comestible opening by means of the cover piece and the degree of tilt of the container assembly.

The cross section area and length of the liquid channel are sized to coarsely restrict the liquid flow to be an appropriate ratio for the mount of dry comestible to be consumed. A finer amount of control of the liquid flow at consumption is obtained by the degree of tilt of the cup or the use of the lip or tongue to restrict the liquid opening. Additional means to control the flow of the liquid are possible by coveting the vent channel opening to the liquid chamber with a finger. If the device is constructed of thermoplastic materials such as members of the polyolefin family, distorting a raised area of the outer container wall which is located in-line with the liquid channel with the thumb or a finger of the hand holding the device will also provide control of the liquid flow.

Other embodiments of the device include the use of a vent opening in the outer container wall rather than at the end of the vent channel. This location of the vent provides for easier covering of the vent with a finger but is more prone to leaking if the device is tipped in the wrong direction. A slide cover piece can be used in place of the previously mentioned cover piece. The slide cover piece uses a slide plate in place of the round disk. The lid contains two raised and parallel holding ribs in which the slide plate moves. The slide cover piece allows more incremental restriction of the comestible opening. Various other designs are possible for the cover piece including a pull tab design with the tab permanently attached to the lid. In the simplest embodiment of the device, it is possible to eliminate the use of the lid and cover plate and rely strictly on the tilting of the device to control the dry comestible flow. This approach requires a greater degree of consumer skill and would be used for consumption of a very large sized comestible or if the device were being used at home rather than while traveling. The liquid channel and the vent channel can be integrally molded into either the inner or the outer container rather than being located between the two containers. This approach is of advantage for a disposable version of this device to be discussed later.

An important feature of this device is that the temperature of the liquid be able to be maintained as long as possible. The design of the liquid containing part of the outer container is cylindrical and in some cases the entire outer container is cylindrical. A cylindrical shape allows the use of thick-walled, annular shaped foam piece that slides over the outside wall of the outer container to provide insulation of the liquid. In another embodiment of the device, the outer container is manufactured in a double walled, insulated construction. This provides a more rigid design, as well as, helps to maintain the temperature of the liquid stored in the outer container by creating a dead air space between the two outer container walls. The space between the two walls of the outer container can also be filled with Styrofoam or polyurethane insulation material. Either of these materials will maintain the temperature of the liquid in the outer container for a longer period of time. This space could also be filled with a chilling gel having a high heat of fusion or be insertable with an annular shaped chilling gel pack. A double walled outer container filled with a chilling gel would be frozen for several hours prior to being filled with liquid. This embodiment of the device would then be able to maintain the liquid temperature for several hours after removal from the freezer. The chilling gel pack could also be designed to fit over the outside of the outer container similar to the annular shaped foam piece. The double wall construction design results in an increased wall thickness of the outer container which requires the use of a snap fit as the seal with the lid. The liquid channel and the vent channel can also be designed into the walls of the outer container.

Several embodiments of the lid are possible depending on how the lid attaches. The lid can attach to one or both containers. The important factor is that a seal is developed between the containers and the lid. The seal keeps the dry comestible and the liquid separated until they exit the device. In addition, the liquid does not leak into the inner container. If the liquid leaks into the inner container, the dry comestible will absorb the liquid and start to stick. This will cause the dry comestible not to flow as easily out of the comestible opening as well as when it is dry. The actual design of the lid seal mechanism is unimportant, as long as it seals. However, the design of the lid seal will determine if the comestible opening is on the perimeter of the lid or if the lid seal extends around the entire perimeter of the lid. In the latter case, the comestibles opening is just inside of the perimeter.

The lid can also fit to just the inner container as long as a liquid tight seal is developed between the inner and the outer container. As an example of this embodiment the lid is a thin, contoured plane of material with a single edge perpendicular to and extending around the entire perimeter of the plane. A small bump or raised area of material on the outside of the perpendicular edge forms a ring on the perpendicular edge and snaps over a similar bump on the inside of the inner container at the top seal surface. A snap fit, compression seal is formed. The inner container seals to the outer container in a similar manner. Since the lid covers the entire perimeter of the inner container, the area around the comestible opening in the lid is designed to fit to the inner container. The inner container is recessed in this area to make the fit as streamlined as possible. This avoids any edges on which the dry comestible could catch as it flows through the comestible opening in the lid. The recessed area extends to the outer container and helps in locating the inner container, the outer container, and the lid in the correct orientation for assembly.

In another lid embodiment, it is necessary for the lid to maintain continuous pressure on the entire surface between the inner and outer containers to develop a liquid tight seal. In this case, the lid will cover the entire perimeter of both of the containers. This is most common in the double walled design of the inner container. In this case the lid also covers the liquid opening and is required to contain a lid exit opening to allow the liquid to flow through the lid. Liquid from the liquid opening of the liquid channel is directed to the lid exit opening by means of a top liquid channel. The top liquid channel is formed by differences in the inside diameter of the outer container and the outside diameter of the inner container at the top edge of the containers such that the liquid is prevented from leaking into the inner container.

Another embodiment of the device will tolerate some leakage into the inner container because a hole with a plug is provided in the bottom of the inner container to allow the user of the device the option of mixing liquid with the dry comestible prior to consumption. If the plug is removed, mixing of the dry comestible with liquid can be accomplished by tilting the container assembly backwards from the direction of normal consumption and holding for a second or two, then tipping it forward to a normal, vertical position. Normal consumption then follows. This embodiment of the device eliminates the need for the vent opening in the outer container. The hole in the bottom of the inner container is positioned to be above the lowest point of the inner container when the container is in its normal, vertical position. If the bottom is flat and the hole is located in this flat bottom, the liquid will drain back into the liquid chamber in the outer container. The liquid that remains in the inner container will wet out some of the dry comestible and will also aid in the flow of the now wetted, dry comestible out of the inner container when the device is tipped forward to the consumption position. The reason for this is that the amount of liquid that remains in the inner container is appropriate for one mouth full of comestible. Tipping the device up for consumption causes this trapped liquid to move out of the inner container leaving a minimal amount of the liquid in the inner container and keeping the remainder of the dry comestible as dry as possible. The liquid movement carries along the wetted comestible. If this flow of the liquid out of the inner container were not present, the wetted comestible would just stick to the walls of the inner container.

Up to this point all of the embodiments of this device that have been discussed are designed to be reusable. Once the dry comestible and liquid are consumed the device easily comes apart and can be cleaned by normal dishwashing methods. This device further facilitates cleaning with the liquid and vent channels located between the two containers. They are completely open when the device is disassembled and thus are easy to clean.

Another embodiment of this device creates the lid integral with the inner container. This is possible if the inner container is blow molded out of thermoplastic material. It will have a thin wall and a hollow cavity which serves as the comestible storage chamber. A section of the wall is cut out to provide a means to fill the comestible storage chamber and to provide a comestible opening for consumption. The comestible opening of the inner container is either covered with one of the embodiments of the cover piece previously discussed or is covered with an adhesively attached plastic, paper, or foil film which serves as an expendable cover piece. The inner container fits into the outer container so that a seal is developed between the two containers and so that the comestible opening extends above the top edge of the outer container and the liquid opening. The flow of the dry comestible is restricted, as previously discussed, by a cover piece or by only partially removing the expendable cover piece. The inner container of this embodiment can be reusable but would more likely be prepackaged with the dry comestible and be disposable. The liquid and vent channels could be integrally molded to the inner container or the outer container. The outer container could also be prepackaged with the liquid and, likewise, be disposable.

The preferred material of construction of the outer container, the inner container, the lid, and the cover plate of the comestibles consumption device is plastic and more specifically members of the polyolefin family which would include polypropylene, and high density, low density, and linear low density polyethylene. Other plastics such as members of the polystyrene or polyesters families of thermoplastics and other materials such as glass, ceramic, aluminum or coated steel could be used but they would not provide the performance and low cost of the polyolefin family. The preferred methods of manufacturing are injection molding, blow molding, or thermoforming but other methods could be used.

BRIEF DESCRIPTION OF THE DRAWINGS

In the drawings, closely related figures have the same number but different alphabetic suffixes.

Reference Numerals In Drawings

| | |
|---|---|
| 12 comestible consumption device | 36 top liquid channel |
| 20 outer container | 37 top inside lip of 20 |
| 22 inner container | 38 double wall cavity |
| 24 lid | 39 liquid chamber |
| 25 expendable cover piece | 40 liquid |
| 26 cover piece | 41 comestible storage chamber |
| 28 liquid channel | 42 dry comestible |
| 29 seal surface between 20 & 22 | 44 lid outer leg |
| 30 vent opening | 45 raised area |
| 31 lid inner leg | 46 vent channel |
| 32 liquid opening | 48 slide cover piece |
| 33 lid exit opening | 52 closed tab |
| 34 comestible opening | 71 hole |
| 35 top outside lip of 22 | 72 hole plug |

DETAILED DESCRIPTION OF THE INVENTION

Figure 1:
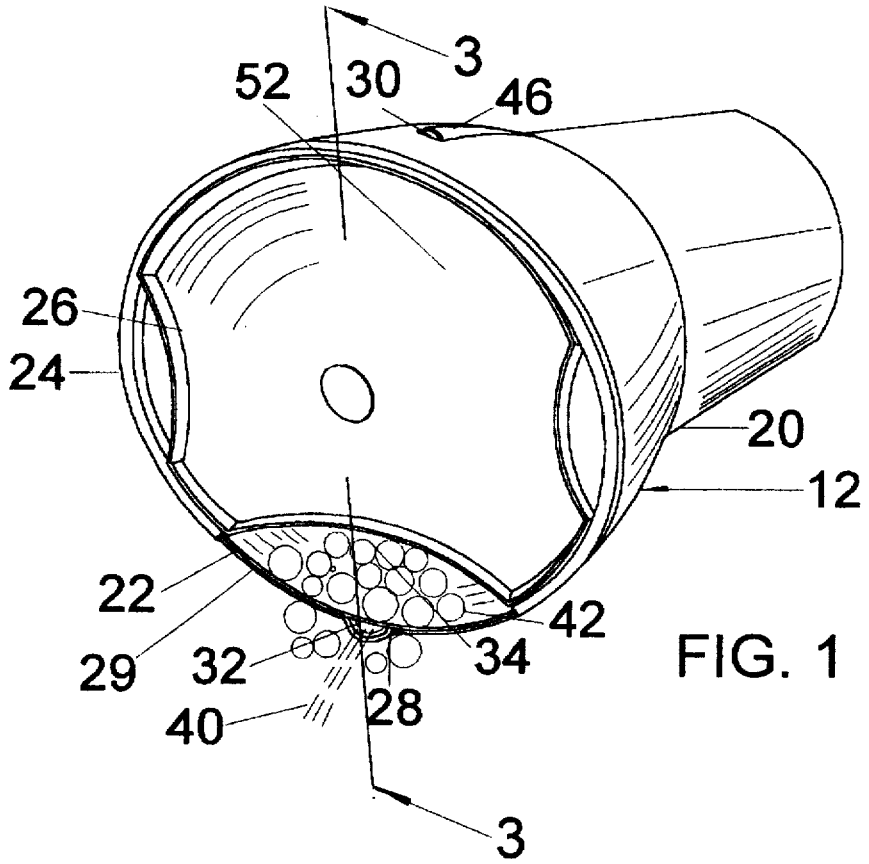
FIG. 1 shows the preferred embodiment of the comestibles consumption device in a consumption position.
Figure 3:
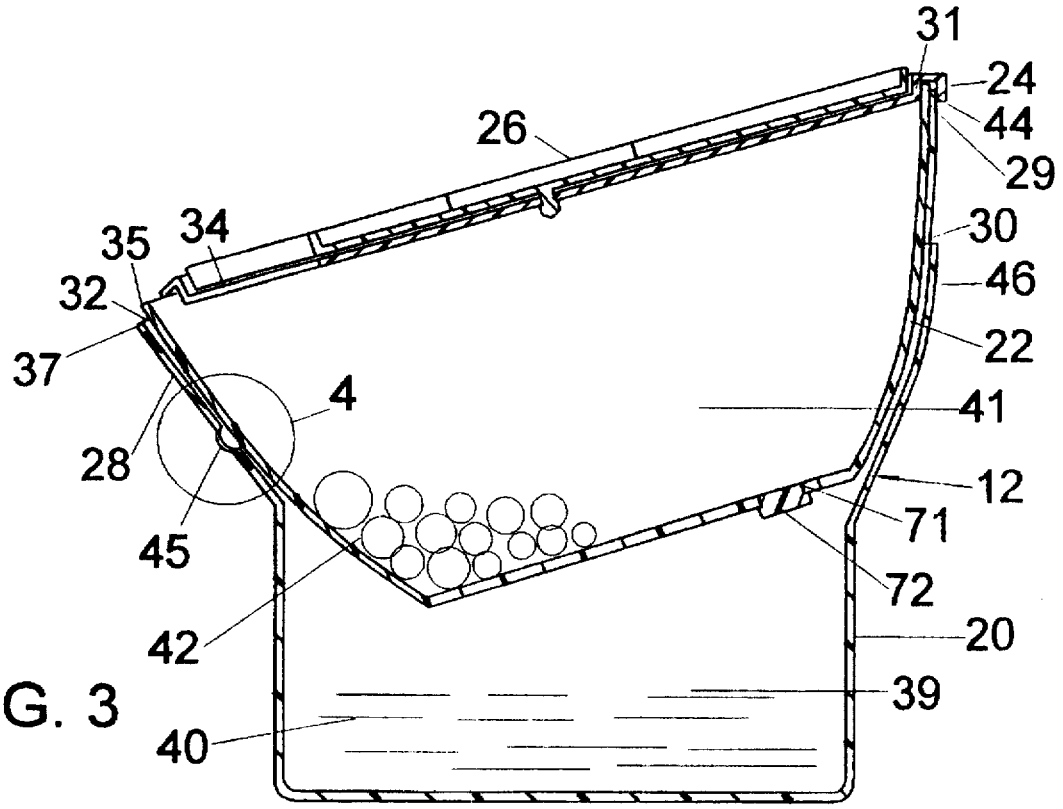
FIG. 3 shows an assembled cross sectional view of the device in FIG. 1 but in a normal, vertical position.
Figure 2:
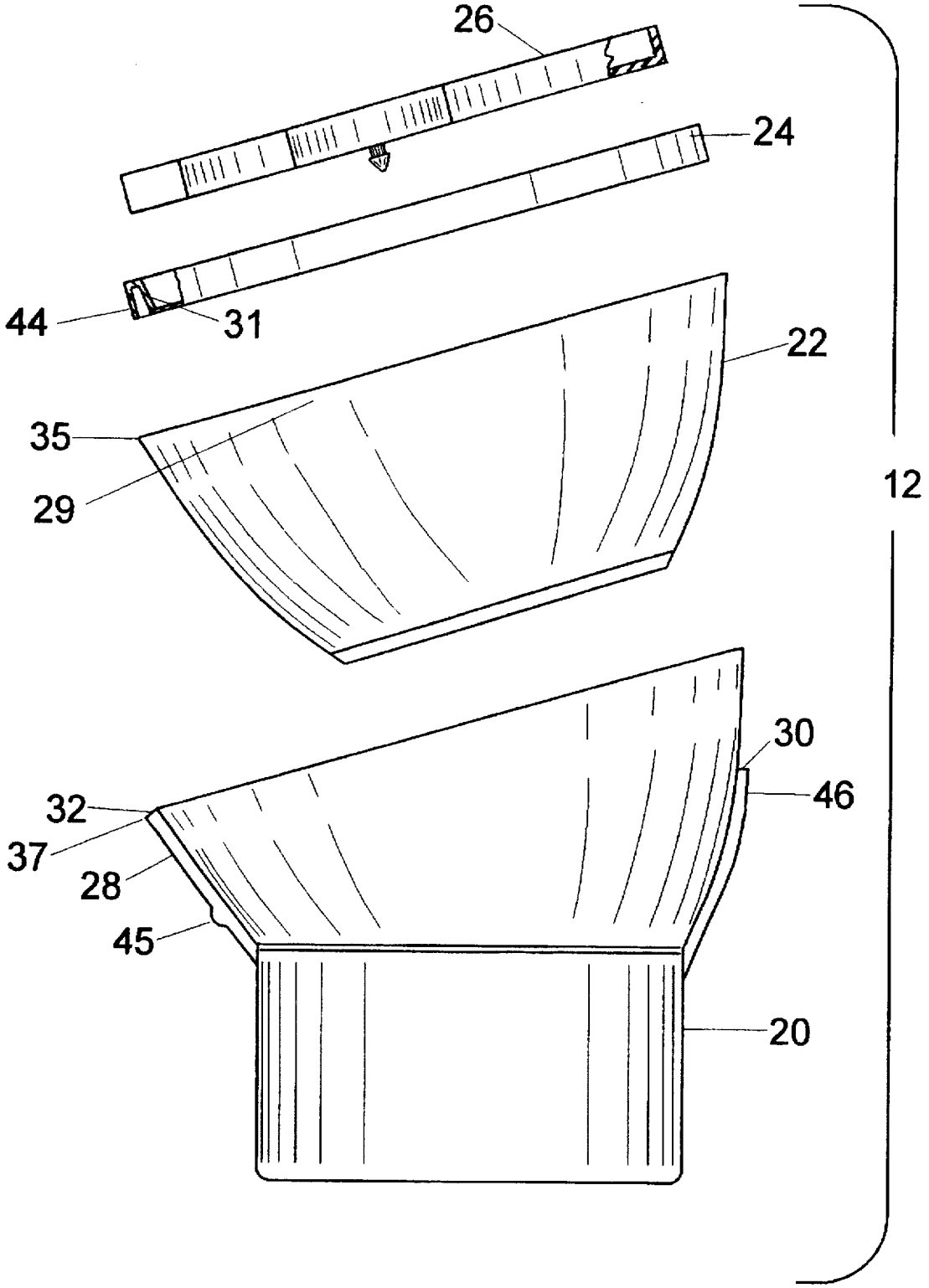
FIG. 2 shows an exploded view of the device in FIG. 1 in a normal, vertical position.

A comestibles consumption device 12 is shown in FIG. 1 rotated into a dispensing position. FIG. 2 shows an exploded view of device 12 in the normal, vertical position. FIG. 3 shows an assembled cross section of device 12 in the normal, vertical position. Device 12 consists of four components. The first component is an outer container 20 for holding a liquid 40 in a liquid chamber 39. The second component is an inner container 22 for holding a dry comestible 42 in a comestible storage chamber 41. Inner container 22 seals to outer container 20. The third component is a lid 24 which contains a comestible opening 34 and a cover piece 26 which is adjustable to control the dispensing of comestible 42. The fourth component is a liquid dispensing system comprising a liquid channel 28 with a liquid opening 32 and a vent channel 46 with a vent opening 30 to control the dispensing of liquid 40.

Containers 20 and 22 are generally rounded, dished, or cylindrical in shape and provide for smooth flow of liquid 40 and comestible 42. Inner container 22 fits inside of outer container 20 such that a seal surface 29 is developed between the side walls of the two containers 20 and 22. Seal surface 29 is located at the top surface of containers 20 and 22, between a top outside lip 35 of inner container 22 and a top inside lip 37 of outer container. Surface 29 extends around the inner circumference of outer container 20 and the outside circumference of inner container 22. The width of surface 29 in the axial or vertical direction is sufficient to prevent liquid 40 from leaking past it when device 12 is tipped for use.

Figure 4A:
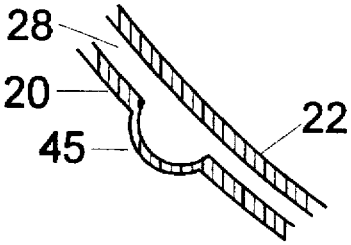
FIG. 4A shows a detail of the raised area which is used to restrict liquid flow.
Figure 4B:
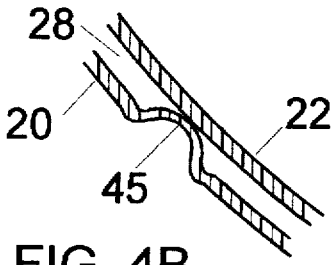
FIG. 4B shows a detail of the raised area depressed to restrict liquid flow.

Lid 24 is sealed to inner container 22 by a lid inner leg 31 and to outer container 20 by a lid outer leg 44. Surface 29 is penetrated by liquid channel 28 and vent channel 46 formed by continuous indentations in the walls of inner container 22 or outer container 20, or both. Liquid 40 is held in chamber 39 located in the lower part of container 20. Liquid channel 28 and liquid opening 32 provide a flow path for liquid 40 to exit chamber 39 when device 12 is tipped for consumption. A vent opening 30 is located at the outside end of vent channel 46. A hole 71 with a plug 72 is shown in the bottom of inner container 22 opposite comestible opening 34. A raised area 45 located on the wall of outer container 20 and in-line with liquid channel 28 is shown. FIGS. 4A and 4B show a detail of the raised area.

Figure 6A:
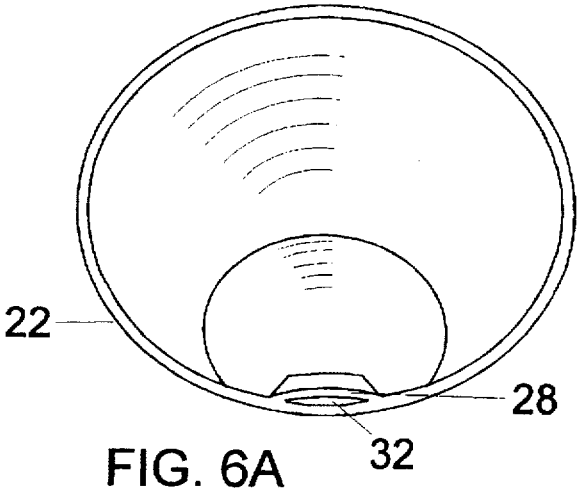
FIG. 6A shows a view of an inner container with an integral liquid channel.
Figure 5:
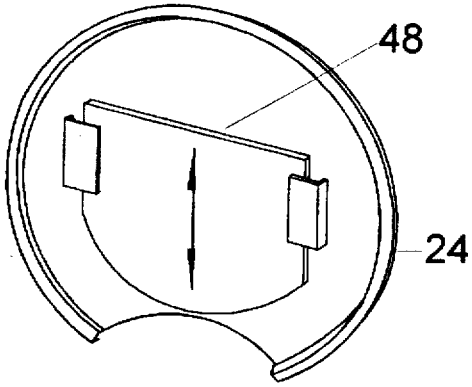
FIG. 5 shows the slide cover piece attached to the lid.
Figure 6B:
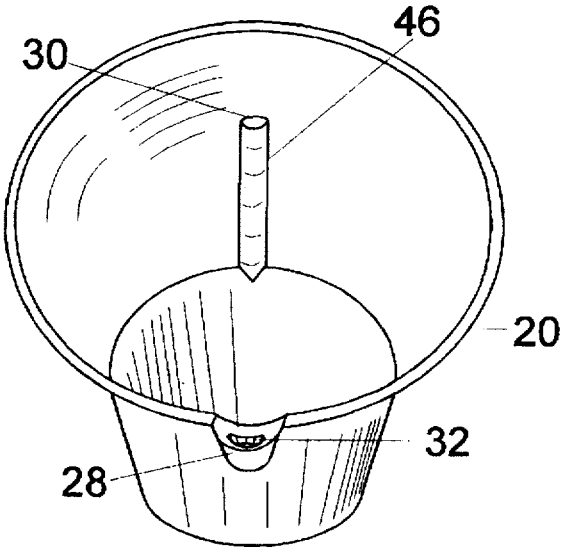
FIG. 6B shows a view of an outer container with an integral liquid channel and an integral vent channel.

Cover piece 26 is used to control the flow of comestible 42 out of chamber 41 and through comestible opening 34. This is shown in FIG. 1. A closed tab 52 which is part of cover piece 26 is located 180 degrees opposite the comestible opening 34. Comestible opening 34 is shown fully open in FIG. 1. FIG. 5 shows a slide cover piece 48 attached to lid 24 in place of cover piece 26 to accomplish the same purpose as cover piece 26. FIG. 6A shows liquid channel 28 molded integral to inner container 22, and FIG. 6B shows liquid channel 28 molded integral to outer container 20. These are optional methods of constructions for the formation of liquid channel 28.

Figure 7:
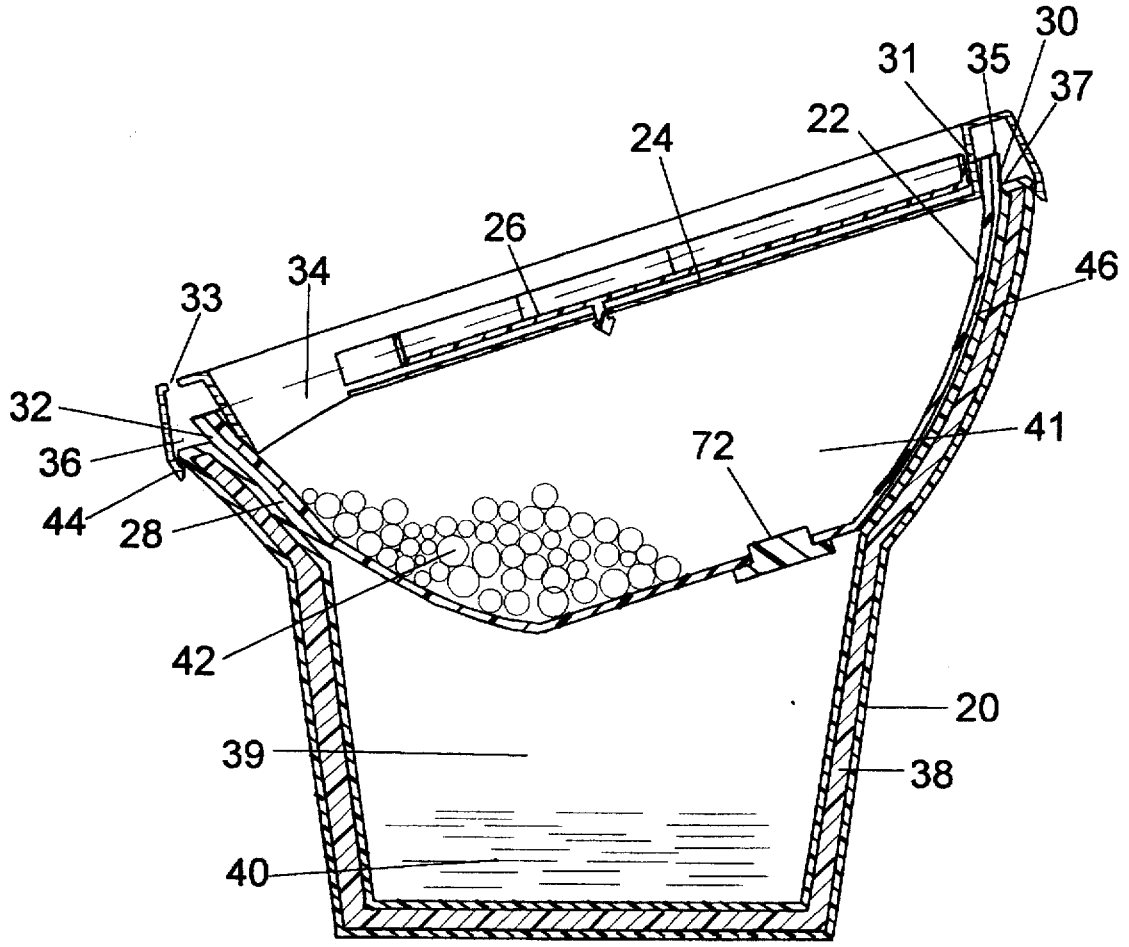
FIG. 7 shows a cross sectional view of the device with a double walled outer container and the formation of a top liquid channel and a lid with a lid exit opening.

FIG. 7 shows a double wall constructed version of outer container 20. Double wall construction is used to better insulate liquid 40. A double wall area 38 is created between the inner and outer walls of outer container 20. Area 38 is shown containing an insulating material such as Styrofoam or urethane in FIG. 7. Also shown in FIG. 7 is a snap fit of lid 24 to outer container 20 at leg 44 and the creation of a top liquid channel 36 between lip 35 and lip 37. Lip 35 extends above lip 37 and prevents any liquid 40 from flowing into inner container 22. Liquid opening 32 opens into top liquid channel 36. Liquid 40 flows from container 20 through liquid channel 28 and liquid opening 32 and then out of a lid exit opening 33 when device 12 is tipped for consumption. The snap fit at leg 44 and top liquid channel 36 prevent any leakage of liquid down the outside wall of outer container 20 or into container 22 during normal consumption and when device 12 is returned to the normal setting position.

Figure 8:
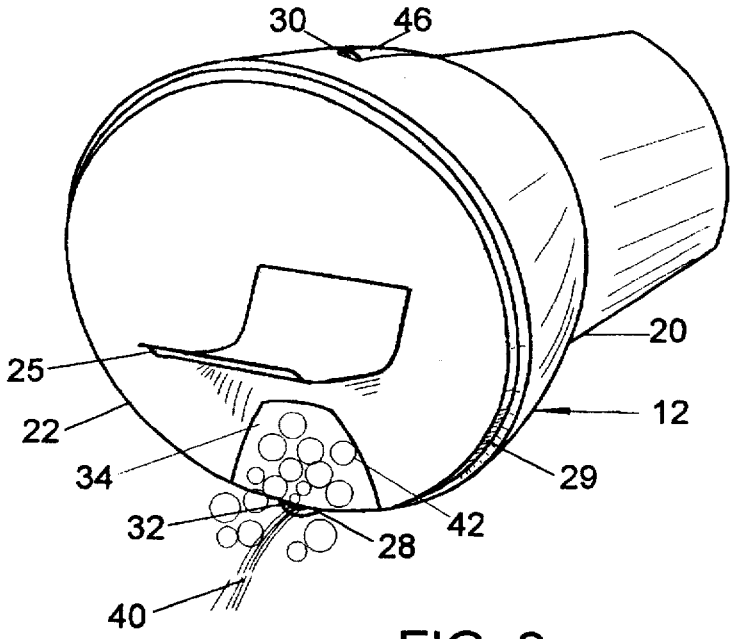
FIG. 8 shows a view of the simplest embodiment of the invention with the lid integral to the inner container and an expendable cover piece.

A disposable embodiment of device 12 is shown in FIG. 8 and consists of three components. These are outer container 20 for holding liquid 40, inner container 22 for holding comestible 42, and a liquid dispensing system. The liquid dispensing system includes liquid opening 32 and vent opening 30 located at the exit of liquid channel 28 and vent channel 46. These channels are formed by continuous indention's between the walls of outer container 20 and inner container 22. Inner container 22 is manufactured from thermoplastic material using the blow molding process and is hollow with an integral top. A section of the integral top of container 22 is cut open to provide comestible opening 34 and to allow filling of container 22 with comestible 42. Liquid 40 and comestible 42 will flow into the mouth of the consumer at comestible opening 34 which is located just above liquid opening 32. Inner container 22 when inserted into outer container 20 seals at surface 29 and sets higher than outer container 20 as shown in FIG. 8. This will prevents liquid 40 from flowing into inner container 22 through comestible opening 34. Comestible opening 34 is covered with an expendable cover piece 25 made of plastic, paper or foil film that is attached by adhesive to container 22. The flow of comestible 42 is restricted by not completely removing expendable cover piece 25.

OPERATION OF THE INVENTION

Referring to FIGS. 2 and 3, the first stage of operation is to fill and assemble device 12. Liquid 40 is placed in outer container 20. Comestible 42 is placed in inner container 22. Inner container 22 is inserted into outer container 20 with the edge of lip 35 flush or slightly above the edge of lip 37. Lid 24 is sealed to outer container 20 by lid outer leg 44 and to inner container 22 by lid inner leg 31 with the centerline of comestible opening 34 aligned with the center line of liquid opening 32 to allow the user of device 12 to consume both liquid 40 and comestible 42 at the same time. Cover piece 26 will close off comestible opening 34 during transport of device 12 when tab 52 is rotated across comestible opening 34.

Figure 9A:
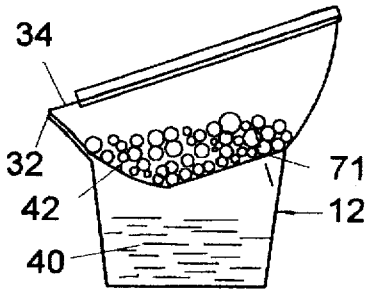
FIG. 9A shows the normal, vertical position of the device.
Figure 9B:
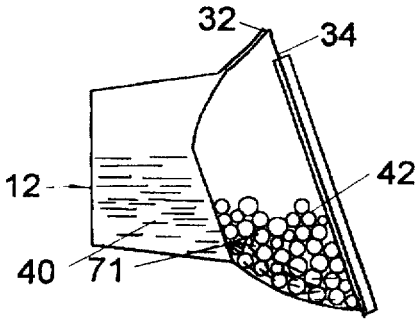
FIG. 9B shows the backward tilting position with the plug hole removed from the inner container bottom and allowing liquid to enter the comestible storage chamber.
Figure 9C:
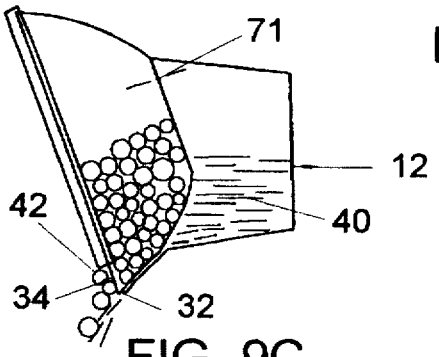
FIG. 9C shows the normal consumption position when the device is tilted for consumption.

The next stage is to consume comestible 42 and liquid 40. Device 12 is held in one hand and placed to the lips of the consumer with liquid opening 32 and comestible opening 34 centered in the lips and thus, the mouth of the consumer. Liquid opening 32 should be at the lowest position of device 12 when it is tilted as shown in FIG. 9C. Tilting of device 12 will cause liquid 40 and comestible 42 to flow into the mouth of the consumer. When a sufficient quantity of both liquid 40 and comestible 42 has been consumed, the consumer will tilt device 12 back to the normal, vertical position shown in FIG. 9A. The ratio of liquid 40 to comestible 42 is controlled by rotating cover piece 26 to expose more of comestible opening 34. The rate of flow of liquid 40 and comestible 42 is controlled by the degree of tilt. If only liquid 40 is desired, comestible opening 34 can be closed by rotating tab 52 of cover piece 26 over comestible opening 34. If only comestible 42 is desired, liquid opening 32 is covered with the tongue or lip to restrict flow of liquid 40. If outer container 20 is made of thermoplastic material such as a member of the polyolefin family, area 45 can be depressed with the thumb or finger to temporarily collapse area 45 of outer container 20 into liquid channel 28 and restrict the flow of liquid 40. FIG. 5B shows a detail of area 45 when it is depressed. When the pressure of the thumb or finger is removed, the wall of outer container 20 will return to its normal shape as shown in FIG. 5A.

Some consumers will prefer to consume comestible 42 partially wetted prior to entering their mouth. It is possible to achieve this with the embodiment of container assembly 12 shown in FIGS. 1, 2, and 3 by removing plug 72 from hole 71 located in the bottom of inner container 22. Hole 71 is located opposite comestible opening 34 in lid 24. Liquid 40 can be made to flow into inner chamber 22. This is done by tipping device 12 back as shown in FIG. 9B and then tipping the container assembly 12 forward and up for consumption as shown in FIG. 9C. Liquid 40 will flow through hole 71 and remain in the bottom of inner container 22 when device 12 is returned to its normal, vertical position shown in FIG. 9A. Liquid 40 will wet comestible 42. When device 12 is tipped forward for consumption as shown in FIG. 9C, the now wetted comestible 42 will flow out of comestible opening 34 along with liquid 40.

CONCLUSION

Thus, the reader will see that the comestibles consumption device of this invention meets the objectives of this patent application in that it provides:

1) A comestibles consumption device for use by a consumer to store and consume various dry comestible products simultaneously with various liquids. The dry comestible or the liquid may also be dispensed individually if desired.
2) A comestibles consumption device requiring the use of only one hand. No additional tools are required to dispense and consume the dry comestibles and the liquid from the device.

3) A comestibles consumption device of simple construction that is easy to clean, low cost to manufacture, and reusable.

4) A comestibles consumption device that the relative ratio of liquid to dry comestible can be varied at the time of dispensing as desired by the consumer.

5) A comestibles consumption device that the liquid and dry comestible can be mixed in a controlled and incremental manner prior to dispensing as desired by the consumer.

While the above description contains many specificities, these should not be construed as limitations on the scope of the invention. Many other variations are possible. Accordingly, the scope of the invention should be determined not by the embodiments illustrated, but by the appended claims and their legal equivalents.

I claim:

1. A comestibles consumption device for dispensing of a liquid and a dry comestible by the force of gravity when tilted for use, comprising:

an outer container for storing said liquid separately from said dry comestible, including at least one bottom and at least one side wall forming a liquid storage chamber with open top capable of being sealed, and being of a size and shape to be hand-held;

an inner container including a least one bottom and at least one side wall forming an open top comestible storage chamber capable of being sealed, capable of holding a normal size serving of said dry comestible, and capable of fitting into said outer container to form a liquid tight seal;

a dry comestible dispensing means attached to said inner container and said outer container, comprising a removable lid with a comestible opening of predetermined size, shape, and location to control the flow of said dry comestible out of said inner container when said device is tilted for use;

a liquid dispensing means comprising at least one liquid channel of predetermined size communicating with said liquid storage chamber at the lower end, extending upward, and ending with a liquid opening adjacent said comestible opening, such that said liquid flows out of said outer container when said device is tilted for use.

2. The comestibles consumption device of claim 1, further including a cover piece attached to said lid in a manner to be able to be adjusted and cover said comestible opening any amount from completely open to completely closed.

3. The comestibles consumption device of claim 1, wherein said lid of said comestible dispensing means comprises a thin, contoured plane of material with an inverted u-shaped seal channel running continuously around the perimeter edge which fits over and resiliently compresses the walls of said inner and outer containers together to form a liquid tight seal: said lid containing said comestible opening.

4. The comestibles consumption device of claim 3, further including said lid with said inverted u-shaped seal channel running continuously around its entire perimeter edge and containing a liquid exit opening for the communication of said liquid from a top liquid channel created between a top outside lip of said inner container and a top inside lip of said outer container and located in said lid in-line with said comestible opening to allow for the flow of said liquid and said dry comestible out of said outer container when said device is tilted for use.

5. The comestibles consumption device of claim 1, wherein said lid of said dry comestible dispensing means comprises a thin, contoured plane of material with a single edge perpendicular to and extending around the entire perimeter of said plane of material forming an annular ring which fits inside of said inner container by means of compression of said perpendicular edge; said lid containing said comestible opening.

6. The comestibles consumption device of claim 1, wherein the shape of said outer container side wall is cylindrical; said outer container being of a size to be hand-held and contain sufficient volume to provide a normal size serving of said dry comestible and said liquid.

7. The comestible consumption device of claim 1, wherein said liquid channel is created by a predetermined gap communicating with said liquid chamber on the lower end, extending upward between said inner and outer container walls, and ending with said liquid opening adjacent said comestible opening.

8. The comestible consumption device of claim 1, wherein at least one liquid channel is created integral to said outer container; communicating with said liquid storage chamber at the lower end, extending upward and through the wall of said outer container, ending with said liquid opening adjacent to said comestible opening.

9. The comestible consumption device of claim 1, further including a vent of said liquid chamber comprised of a hole in said outer chamber, located so as to prevent said liquid from leaking out of said outer chamber when held in a normal, vertical position and when held in a tilted position for consumption.

10. The comestibles consumption device of claim 1, wherein said outer container comprises two bottoms and at least two side walls sealed together to form a double walled cavity for the purpose of maintaining the temperature of said liquid in said outer container.

11. The comestible consumption device of claim 10, wherein said double wall cavity in said outer container is filled with insulation material.

12. The comestibles consumption device of claim 1, further including at least one hole located in the bottom of said inner container in such a manner to allow said liquid to enter said inner container and mix with said dry comestible; to remain in said inner container when said device is tilted in a direction opposite the normal consumption tilting direction and then tilted to the normal, vertical position; and to dispense out said wetted, dry comestible and said liquid when device is tilted in the normal consumption direction for use.

13. The comestibles consumption device of claim 1, wherein said device parts are constructed of plastic materials including any members of the polyolefin family, the polystyrene family, or the polyester family.

14. The comestibles consumption device of claim 13, further including a raised area on the outer container wall, located in-line with the said liquid channel, such that when said raised area is depressed with a thumb or finger, said raised area will locally collapse into and restrict the flow of said liquid in said liquid channel and will resiliently return to an uncollapsed position when thumb or finger is removed.

15. A comestibles consumption device for dispensing of a liquid and a dry comestible by the force of gravity when tilted for use, comprising:

an outer container for storing said liquid separately from said comestible, including at least one bottom, at least one side wall forming a liquid storage chamber with open top capable of being sealed, and being of a size and shape to be hand-held;

a plastic inner container including at least one bottom, at least one side wall, and a top, forming a comestible storage chamber of sufficient size and shape to hold a normal serving of said dry comestible, and fitting to said outer container to form a liquid tight seal;

a dry comestible dispensing means comprising a comestible opening of predetermined size, shape, and location to allow filling of said comestible storage chamber with said dry comestible and to allow said dry comestible to flow out of said inner container by the force of gravity when said device is tilted for use;

a liquid dispensing means comprising at least one liquid channel created by a gap of predetermined size between said inner and said outer container communicating with said liquid storage chamber at the lower end, extending upward and ending with a liquid opening adjacent said comestible opening, such that said liquid flows out of said outer container when said device is tilted for use.

16. The comestible consumption device of claim 15, wherein at least one of said liquid channel is created integral to said inner container, such that said liquid channel is open on the bottom to communicate with said liquid storage chamber, extends upward, through said inner container, and ends with said liquid opening at the top of said inner container without allowing said liquid to enter said inner container.

17. The comestible consumption device of claim 15, further including an expendable cover piece comprised of a thin membrane of plastic, paper or foil that is attached by adhesive to said inner container and is capable of partial opening in order to restrict said comestible opening any mount from completely closed to completely open.

18. The comestible consumption device of claim 15, further including a cover piece which is attached to the top of said inner container in a manner to allow said cover piece to be moved and held in place to restrict said comestible opening any amount from completely closed to completely open.

19. The comestibles consumption device of claim 15, further including at least one hole located in the bottom of said inner container in such a manner to allow said liquid to enter said inner container and mix with said dry comestible; to remain in said inner container when said device is tilted in a direction opposite the normal consumption tilting direction and then tilted to the normal, vertical position; and to dispense out said dry comestible and said liquid when device is tilted in the normal consumption direction for use.

20. A comestibles consumption device for dispensing of a liquid and a dry comestible by the force of gravity when tilted for use, comprising:

an outer container for storing said liquid separately from said dry comestible, including at least one bottom, at least one side wall forming a liquid storage chamber with an open top capable of being sealed, and being of a size and shape to be hand-held;

an inner container including a least one bottom and at least one side wall forming an open top comestible storage chamber of sufficient size and shape to hold a normal serving of said dry comestible, to fit to said outer container to form a liquid tight seal, and to allow said dry comestible to flow out of said inner container by the force of gravity when said device is tilted for use;

a liquid dispensing means comprising at least one liquid channel created by a predetermined gap between said inner and said outer container, communicating with said liquid storage chamber at the lower end, extending upward, and ending with a liquid opening adjacent and just below said inner container top, such that said liquid flows out of said outer container when said device is tilted for use.

* * * * *